United States Patent [19]

Kawai et al.

[11] Patent Number: 5,047,689

[45] Date of Patent: Sep. 10, 1991

[54] GAS DISCHARGE TUBE, INDIRECTLY HEATED CATHODE FOR USE THEREIN AND DRIVE CIRCUIT THEREFOR

[75] Inventors: Koji Kawai; Yuji Shimazu, both of Shizuoka, Japan

[73] Assignee: Hamamatsu Photonics K.K., Shizuoka, Japan

[21] Appl. No.: 483,767

[22] Filed: Feb. 21, 1990

[30] Foreign Application Priority Data

Feb. 21, 1989 [JP] Japan ..... 1-41000

[51] Int. Cl.[5] ..... H05B 41/14

[52] U.S. Cl. ..... 315/94; 315/49; 315/50; 315/58; 315/107

[58] Field of Search ..... 315/49, 50, 58, 71, 315/94, 102, 106, 107, 240

[56] References Cited

U.S. PATENT DOCUMENTS 4,438,370 3/1984 Allington ..... 315/106

4,742,276 5/1988 Ku ..... 315/106

*Primary Examiner*—David Mis

*Attorney, Agent, or Firm*—Finnegan, Henderson, Farabow, Garrett and Dunner

[57] ABSTRACT

A gas discharge tube comprises an indirectly heated cathode structure including a hot cathode into which a heater is incorporated. During discharging, the heater is supplied with a discharge current so as to generate Joule heat which is used as a heat source for the hot cathode. To this end, in a drive circuit in which the heater is preheated with a heater power source to initiate the discharging and to light up the discharge tube, followed by supply of discharging power from a discharging maintaining power source, a preheating switch is inserted between the heater and heater power source, and is opened at a start of the discharging and kept opened thereafter.

5 Claims, 1 Drawing Sheet

1
2
3
4
5
6
7
8
9
10
11
12
13
14
15
16
17
A
B 1
2
3
4
5
6
7
8
9
10
11
12
15
16
17

2
3
21
24
25
26
A
B 2
3
21
24
26
A
B 1
2
11
12
13
22
23

GAS DISCHARGE TUBE, INDIRECTLY HEATED CATHODE FOR USE THEREIN AND DRIVE CIRCUIT THEREFOR

BACKGROUND OF THE INVENTION

The present invention relates to a gas discharge tube to be principally used as a light source in analytical and quantitative measurements. The present invention also relates to an indirectly heated cathode for use with said gas discharge tube and a drive circuit for driving those.

A deuterium lamp as a gas discharge tube is shown in FIG. 5. The deuterium lamp generally indicated by 1 comprises a transparent sealed envelope 13 in which are housed an anode 11, a cathode 2 and a shield electrode 12. A small hole 22 for converging electrons and a window 23 through which light is transmitted are formed in the shield electrode 12. When a voltage is applied between the anode 11 and the cathode 2 with the latter being heated, an arc discharge is produced between the anode 11 and cathode 2 via the small hole 22. Only part of the anode light can be transmitted through the small hole 22 and then passes through the window 23, so that the small hole 22 acts as a point light source which emits high intensity light.

An indirectly heated cathode that may be used advantageously in the deuterium lamp 1 is described in Japanese Patent Application Examined Publication No. Sho. 62-56628. As shown in FIG. 3, this cathode comprises a cylinder 24 that is made of a heat-resistant and highly heat conductive material such as molybdenum and which is surrounded on its outer wall with a double coil 25 that is formed by winding a tungsten wire filament into a primary coil, which in turn is wound spirally into a secondary coil. A carbonate of barium, strontium or calcium that is in either an elemental or mixed form is applied both between turns of the primary coil and between turns of the secondary coil. A heater 3 in coil form is provided in the interior of the cylinder 24 which is mounted in the discharge tube by means of a support 21. The cylinder 24 is in electric connection with the heater 3 through the support 21. When an electric current is applied to the heater 3 with the discharge tube held in vacuum ($\leqq 10^{-3}$ Torr), the carbonate undergoes a thermal decomposition reaction to form an electron emitting material 26 made of an oxide.

FIG. 2 shows a trigger type drive circuit which is most commonly used to drive gas discharge tubes. The heater 3 is constantly supplied with power from a heater power source 4 for a preheating purpose. After preheating for 10–60 seconds, a trigger switch 5 is changed over from a normally closed contact 6 to a normally open contact 7 and the electric charge stored in a capacitor 8 is discharged to light the discharge tube 1. However, the power consumption of the indirectly heated cathode 2 is so large that in order to insure stable operation of the indirectly heated cathode 2 in the gas discharge tube 1 during discharging, power must be continuously supplied from the heater power source 4 even after the discharge tube lit up.

As described above, the indirectly heated cathode 2 used in the conventional deuterium discharge tube 1 has had to employ the heater power source 4 which constantly supplies said cathode with power during discharging so that it works as an effective hot cathode that maintains a stable arc discharge. In other words, the conventional indirectly heated cathode 2 has suffered the disadvantage of consuming large power.

SUMMARY OF THE INVENTION

An object, therefore, of the present invention is to provide a gas discharge tube that is capable of generating Joule heat by applying a discharge current to an indirectly heated cathode after discharging is started.

This object of the present invention can be attained by a gas discharge tube in which a heater incorporated in an indirectly heated cathode structure is supplied with a discharge current during discharging so as to generate Joule heat which is used as a heat source for the cathode.

In an embodiment of the present invention, the heater is made of tungsten, molybdenum, tantalum or an alloy thereof and is so set that its surface temperature (T) will lie in the range of $500 < T < 1{,}400°$ C. during its operation.

In another embodiment of the present invention, the heater has a resistive component when supplied with a discharge current so that it assists in compensating for the resistance of the gas discharge tube having negative resistance characteristics.

In still another embodiment, the heater is supplied with a discharge current during discharging so as to have the associated heater circuit enter into a constant-current operation so that the cathode is supplied with a constant amount of heat within the limits of supply voltage from a discharge maintaining power source irrespective of the voltage drop that may occur between the terminals of the discharge tube and the power source.

The above-stated object of the present invention can also be attained by a drive circuit for a gas discharge tube that preheats a discharge tube heater with a heater power source to initiate discharging and to light up the discharge tube, followed by supply of discharging power from a discharge maintaining power source, which drive circuit is characterized in that a preheating switch to be opened after discharging is inserted between said heater and the heater power source.

DETAILED DESCRIPTION OF THE INVENTION

Figure 1:
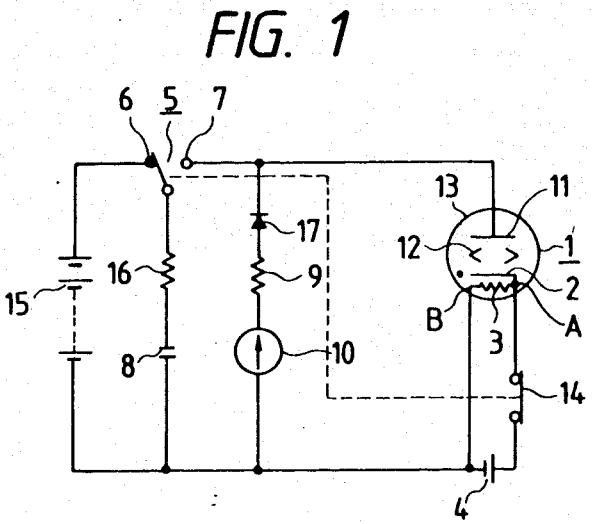
FIG. 1 is an electric circuit diagram showing a drive circuit for driving a gas discharge tube according to one embodiment of the present invention.
Figure 2:
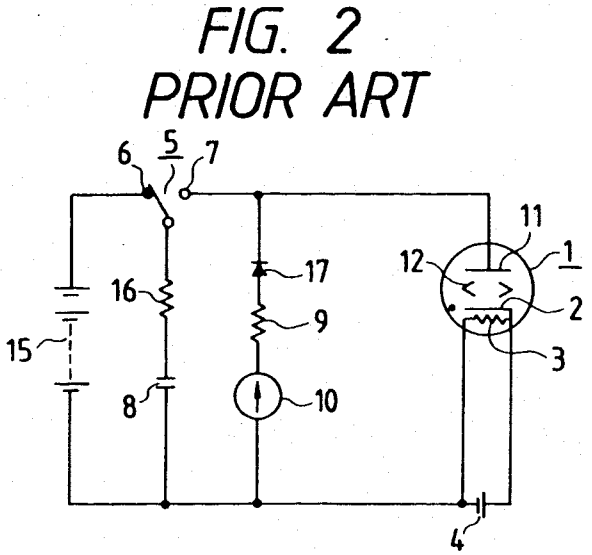
FIG. 2 PRIOR ART
FIG. 2 is a prior art drive circuit.
Figure 3:
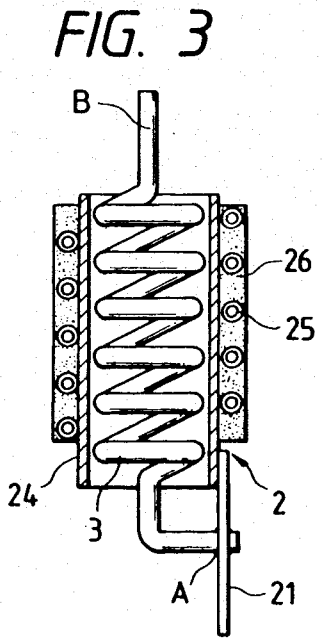
FIG. 3 is a sectional view of a cathode structure of a type that performs discharging on the lateral side.
Figure 5:
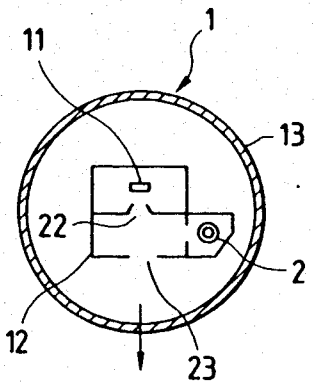
FIG. 5 is a cross section of a gas discharge tube.

Referring to FIGS. 1, 3 and 5, preferred embodiments of the invention is described hereinafter.

The heart of the present invention lies in the fact that a discharge current (Ip) flowing during discharging is on the order of 1–2 A/cm$^2$ in vacuum whereas a current of approximately 5–15 A/cm$^2$ can be picked up in a hydrogen (or deuterium) gas at a pressure of 0.005–0.03 atm. Most of deuterium discharge tubes used today produce a discharge current of 0.3 A and, in the present invention, this current is not only used for the purpose of discharging but also directed to a heater 3 in an indirectly heated cathode 2, to thereby generate Joule heat in the heater 3 to serve as a heat source for the hot cathode 2.

When the heater circuit enters into a constant-current operation, the cathode 2 is supplied with a constant amount of heat within the limits of supply voltage from a discharge maintaining power source 10 irrespective of the voltage drop that may occur between the terminals of the discharge tube and the power source 10 and the cathode 2 is capable of operating in a consistent manner.

In a drive circuit of the present invention, a preheating switch 14 is closed and the heater 3 is preheated by being supplied with power from the heater power source 4. After the preheating, a discharge starting operation is performed to light up the discharge starting operation is performed to light up the discharge tube 1. After the tube is lit, the preheating switch 14 is opened either in operative association with the discharging operation or manually. At the same time, the power supplied from the discharge maintaining power source 10 keeps the discharge tube 1 lit up during discharging.

The amount of heat necessary to insure that the indirectly heated cathode 2 used with the deuterium discharge tube 1 would operate in a consistent way (not more than 0.5% per hour of drifts in optical output, and not more than $0.05\%_{p\text{-}p}$ of fluctuations) was closely investigated using the external heater power source 4. As a result, the following relationship was observed:

$$W_{ou} \alpha SS \quad (1)$$

where $W_{ou}$: the amount of heat applied to the cathode 2 from the heater 3 using the external heater power source 4; and SS: the surface area of the cathode 2; and provided that $0.6 < W_{ou} = < 6$ W, $14 < SS < 53.1$ mm$^2$, and the discharge current $I_p = 0.3$ A.

Hence, the voltage, $V_h$, that needs to be produced is determined by:

$$V_h = W_{ou}/I_p \quad (2)$$

If a wire filament made of tungsten or a tungsten alloy is designed so as to meet this condition (2), an indirectly heated cathode can be produced that has the same characteristics as the prior art version and which yet is capable of operating in a consistent way without requiring the external heater power source 4.

The heater 3 works as a resistor during discharging and is capable of assisting in compensating for the resistance of the deuterium discharge tube 1 having negative resistance characteristics. In the circuit shown in FIG. 1, a resistance 9 which usually has a value of at least 50 ohms is inserted as an active element or resistor for compensating for the negative resistance characteristics of the deuterium discharge tube 1. If the resistance of the heater 3 is 20 ohms during its operation, the value of the resistance 9 can be reduced to 30 ohms and above.

An example of the indirectly heated cathode that meets the requirements of the present invention may comprise a cylinder 24 having an outside diameter of 1.65 mm, an inside diameter of 1.50 mm and a length of 3.0 mm, and made of molybdenum, tantalum, nickel or an alloy thereof; a heater 3 in the form of an alumina-coated, 1.3 mm-diameter double coil formed out of a wire having a diameter of 0.065 mm and made of tungsten, molybdenum, tantalum or an alloy thereof; and a double coil 25 made of tungsten, molybdenum, tantalum or an alloy thereof, and wrapped around the cylinder 24. The heater 3 is designed to have a resistance of 18–22 ohms so that it will develop a voltage of 5.5–6.5 volts by being supplied with a discharge current during discharging.

We now discuss the surface temperature of the heater 3.

The electron emitting surface of the hot cathode 2 must be at least 600° C. in order to insure its stable operation. The heater 3 has dual purpose, one for supplying heat to the cathode 2 and the other for keeping it hot. Heat can also be supplied to the cathode 2 by impact of gas ions against the surface of the cathode 2. Thus, a minimum of a surface temperature (T) of the heater 3 that is necessary to insure stable operation of the indirectly heated cathode 2 is 500° C. at the time when a discharge current is supplied to said heater 3. Below 500° C., the ability of the heater 3 to keep the cathode 2 hot decreases and the amount of heat supplied to the cathode 2 is too small to insure the stable operation (the stability of cathode operation is evaluated by variations in the optical output of the discharge tube 1 when it is lit up, and the cathode operation is stable if the fluctuation in the optical output is not more than $0.05\%_{p\text{-}p}$ and it is unstable if the fluctuation is greater than $0.05\%_{p\text{-}p}$). If $T > 1{,}400°$ C., the insulating alumina coating on the heater 3 will evaporate to potentially cause the shorting of the heater 3 and the cathode 2 or accelerate the evaporation of the electron emitting material 26 on account of excess heat.

Assuming the use of tungsten with the discharge current of 0.3 A, it was found that the filament diameter (d) necessary for the heater 3 to satisfy the relationship $500 < T < 1{,}400°$ C. was within the range of $0.0364 < d < 0.0892$ mm.

A trigger type drive circuit of the invention is described below with reference to FIG. 1.

Shown by numeral 3 in FIG. 1 is a heater. One end A of the heater 3 is connected to a support 21 as shown in FIG. 3 and is also connected to a preheating switch 14. The other end B of the heater 3 is connected to the negative side of a heater power source 4. A trigger power source 15, normally closed contact 6 of a trigger switch 5, resistor 16 and capacitor 8 form a closed circuit. A normally open contact 7 of the trigger switch 5 is connected to an anode 11 and a discharge maintaining power source 10. The circuit shown in FIG. 1 includes an diode 17 for preventing a reverse current flow.

The drive circuit having the configuration described above will operate as follows. The preheating switch 14 is closed to preheat the cathode 2 by supplying an electric current to the heater 3. After 10–60 seconds of preheating, the trigger switch 5 is changed over from the normally closed contact 6 to the normally open contact 7, whereupon the discharge tube 1 is triggered by the electric charge stored in the trigger capacitor 8 and starts to light up by discharging. After the discharge tube 1 is lit up, the trigger switch 5 is brought back to the normally closed contact 6 and the discharge maintaining power source 10 takes over to continue the lighting of the discharge tube 1. At the same time, the preheating switch 14 is opened. The cathode 2 must be preheated to a predetermined temperature by the heater 3 in order to insure that the cathode 2 will operate consistently during the discharging period. In accordance with the present invention, even if the preheating switch 14 is opened, a discharge current will flow from the cathode 2 into the heater 3 to provide the necessary amount of heat to continue the stable operation of the cathode 2.

This operation of the heater 3 is a constant-current operation, so the amount of heat being supplied to the cathode 2 will not vary even if variations occur in the distance between the terminals of the discharge tube 1 and the power source 10.

The heater can operate in two different modes, constant-voltage operation and constant-current operation. In the case of the constant-voltage operation, the following relationship holds:

$$\text{Total amount of heat, } W = W_0 + W_1 + W_2 + \frac{V_0^2}{R_0} + \frac{V_1^2}{R_1} + \frac{V_2^2}{R_2} = \frac{V^2}{R}$$

where $W_0$: the amount of heat generated in the heater 3;

$R_0$: heater resistance;

$V_0$: heater voltage;

$W_1$: the amount of heat generated between one terminal of the heater 3 and one terminal of the power source 10;

$R_1$: the resistance between those terminals;

$V_1$: the voltage between those terminals;

$W_2$: the amount of heat generated between the anode 11 and the other terminal of the power source 10;

$R_2$: the resistance between those terminals; and $V_2$: the voltage between those terminals.

Since the total voltage V is constant, a variation in the distance between the terminals of the heater 3 and the power source 10 and the distance between the terminals of the anode 11 and the power source 10 will result in a variation in $W_0$.

However, in the present invention in which the heater 3 operates at a constant current, $I_p$ and $R_0$ in the relation $W_0 = I_p^2 R_0$ are both constant, so $W_0$ is held constant in spite of variations that occur in $R_1$ or $R_2$ on account of variations in the distance between the corresponding terminals. In the present invention, since the discharge current $I_p$ flowing through the heater 3 is supplied from the power source 10, so the heater 3 will operate consistently without causing variations in the amount of heat supplied to the cathode 2 if the following relationship is satisfied:

$$V_m \geqq V_{p+\nu 0} + V_1 + V_2$$

where $V_m$: the maximum voltage that can be supplied from the discharge maintaining power source 10; and $V_p$: the voltage consumed to maintain discharging (inclusive of the discharge tube voltage).

It should be noted that in the invention the electron emitting material 26 may be either an impregnated or sintered type.

Figure 4:
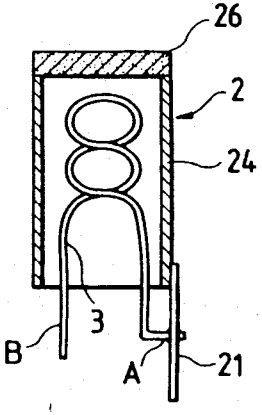
FIG. 4 is a sectional view of a cathode structure of a type that performs discharging at the top end.

The indirectly heated cathode structure shown in FIG. 3 is of a type that causes discharge on the lateral side. It should, however, be noted that the concept of the present invention is applicable unmodified to a structure of the type shown in FIG. 4 which causes discharge at a top end having an electron emitting material 26 formed thereon. In this case, the terminals A and B of the heater 3 correspond to A and B in FIG. 1, respectively.

The present invention offers the following advantages:

(1) In the design of a power source circuit, the operation of a heater power source need not be considered during the time when the discharge tube is lit up;

(2) Two power sources are conventionalized to keep the discharge tube lit up, but, in the present invention, only one power source suffices and the number of power-source-related factors that may cause unstable operation is reduced by half;

(3) The operation of the cathode is as stable as the conventional indirectly heated cathode which is heated by a dedicated heater power source also during discharging;

(4) The heater works as a resistor during its operation and this reduces the resistance necessary to compensate for the negative resistance characteristics of the discharge tube; and (5) The heater is capable of constant-current operation, so even if variations occur in the distance between the terminals of the discharge tube and the power source, the amount of heat supplied to the cathode remains constant to insure its stable operation.

What is claimed is:

1. In a gas discharge tube comprising an indirectly heated cathode structure including a hot cathode into which a heater is incorporated, the improvement wherein during discharging said heater is supplied with a discharge current so as to generate Joule heat which is used as a heat source for said hot cathode.

2. A gas discharge tube according to claim 1, wherein said heater is made of tungsten, molybdenum, tantalum or an alloy thereof and is so set that its surface temperature T is in a range of $500 < T < 1{,}400°$ C. during its operation.

3. A gas discharge tube according to claim 1, wherein said heater has a resistive component when supplied with said discharge current, whereby said resistive component assists in compensating for a resistance of said gas discharge tube having negative resistance characteristics.

4. A gas discharge tube according to claim 1, wherein said heater is supplied with said discharge current during discharging so as to have an associated heater circuit including said heater and a discharge maintaining power source enter into a constant-current operation, whereby said cathode is supplied with a constant amount of heat within a limit of supply voltage from said discharge maintaining power source irrespective of a voltage drop that occurs between terminals of said discharge tube and said discharge maintaining power source.

5. In a drive circuit for a gas discharge tube in which a heater is preheated with a heater power source to initiate discharging and to light up said discharge tube, followed by supply of discharging power from a discharge maintaining power source, the improvement comprising a preheating switch inserted between said heater and said heater power source, said preheating switch being opened at a start of said discharging and kept opened thereafter so as to have a discharge current flow through said heater.

* * * * *